US009328530B2

(12) United States Patent
Bailey et al.

(10) Patent No.: US 9,328,530 B2
(45) Date of Patent: May 3, 2016

(54) LINE START/END POST OR CORNER POST FOR A FENCE

(75) Inventors: John Bailey, La Fleche (FR); Sebastien Hainos, Ecommoy (FR); Valery Hamm, La Fleche (FR)

(73) Assignee: LACME HOLDING, Colombes (FR)

( * ) Notice: Subject to any disclaimer, the term of this patent is extended or adjusted under 35 U.S.C. 154(b) by 452 days.

(21) Appl. No.: 13/575,140

(22) PCT Filed: Jan. 20, 2011
(Under 37 CFR 1.47)

(86) PCT No.: PCT/FR2011/050097
§ 371 (c)(1),
(2), (4) Date: Oct. 22, 2012

(87) PCT Pub. No.: WO2011/095720
PCT Pub. Date: Aug. 11, 2011

(65) Prior Publication Data

US 2013/0256619 A1 Oct. 3, 2013

(30) Foreign Application Priority Data

Feb. 5, 2010 (FR) ..... 10 50839

(51) Int. Cl.

| | |
|---|---|
| ***B21F 27/00*** | (2006.01) |
| ***E04H 17/02*** | (2006.01) |
| ***E04H 17/08*** | (2006.01) |
| ***E04H 17/22*** | (2006.01) |

(52) U.S. Cl.
CPC ..... *E04H 17/08* (2013.01); *E04H 17/22* (2013.01); *Y10T 29/49954* (2015.01)

(58) Field of Classification Search
CPC ..... E04H 17/08; E04H 17/22
USPC ..... 256/21, 22, 34, 30, 31, 35, 36, 39, 47, 256/48, 51, 64, DIG. 5
See application file for complete search history.

(56) References Cited

U.S. PATENT DOCUMENTS

| | | | | | |
|---|---|---|---|---|---|
| 999,786 | A | * | 8/1911 | Heyerly | 256/35 |
| 1,017,833 | A | * | 2/1912 | White | 52/152 |
| 1,504,494 | A | * | 8/1924 | Parsons | 256/35 |
| 1,764,207 | A | * | 6/1930 | Johnson | 52/151 |

(Continued)

FOREIGN PATENT DOCUMENTS

| | | |
|---|---|---|
| AU | 727 461 B2 | 12/2000 |
| FR | 1 070 800 A1 | 8/1954 |

(Continued)

OTHER PUBLICATIONS

International Search Report, dated May 10, 2011, from corresponding PCT application.

*Primary Examiner* — Gregory Binda
*Assistant Examiner* — Nahid Amiri
(74) *Attorney, Agent, or Firm* — Young & Thompson

(57) ABSTRACT

A line start/end post or corner post (1) for a fence, the post including a first metal picket (2) to be driven into the ground (5) in a substantially vertical position, a reinforcing element that includes a second metal picket (3) to be obliquely placed between the first picket (2) and the ground (5) within a non-sink part taken from the first picket (2), and a connecting element (4) made of fence wire and connecting a first extremity (3*b*) of the second picket (3), laid on the ground (5), to the first picket (2).

17 Claims, 8 Drawing Sheets

(56) References Cited

U.S. PATENT DOCUMENTS

| | | | | | |
|---|---|---|---|---|---|
| 1,924,834 | A * | 8/1933 | Carrel | 52/154 |
| 1,956,767 | A * | 5/1934 | Kibler | 256/21 |
| 2,107,589 | A | 2/1938 | Orville | |
| 2,147,496 | A | 2/1939 | Nelson | |
| 2,799,369 | A | 7/1957 | Walton | |
| 4,349,181 | A * | 9/1982 | Asher et al. | 256/35 |
| 4,479,636 | A * | 10/1984 | King | 256/35 |
| 4,893,787 | A * | 1/1990 | Watson | 256/35 |
| 5,003,716 | A * | 4/1991 | Dyar | 40/503 |
| 5,435,524 | A * | 7/1995 | Ingram | 256/12.5 |
| 5,649,690 | A * | 7/1997 | Kilmer | 256/35 |
| 6,247,273 | B1 * | 6/2001 | Nickel | 52/127.2 |
| 6,370,817 | B1 * | 4/2002 | Brooks et al. | 47/43 |
| 6,550,188 | B2 * | 4/2003 | Bolinger et al. | 52/127.2 |
| 6,854,222 | B2 * | 2/2005 | Hansort | 52/127.2 |
| 6,874,767 | B1 * | 4/2005 | Gibbs | 256/65.08 |
| 7,025,016 | B1 * | 4/2006 | Landes | 116/209 |
| 7,377,020 | B1 * | 5/2008 | Bartling et al. | 29/525.01 |
| 7,913,463 | B2 * | 3/2011 | Russell | 52/127.2 |
| 2003/0042475 | A1 * | 3/2003 | Passafuma | 256/35 |

FOREIGN PATENT DOCUMENTS

| | | |
|---|---|---|
| FR | 2 190 147 A5 | 1/1974 |
| FR | 2 422 014 A1 | 11/1979 |

* cited by examiner

LINE START/END POST OR CORNER POST FOR A FENCE

BACKGROUND OF YHE INVENTION

1. Field of the Invention

This invention relates to a line start/end post or corner post of a fence.

2. Description of the Related Art

Corner fence posts are known, for example, from document U.S. Pat. No. 2,107,589 in which a wooden corner post is propped by a strengthening element comprising a metal section, a tension wire passing around the corner post, both extremities of which are looped through the eye of a threaded bolt. This tension wire is very rigid because, with the extremities thereof simply folded over, it resists the tension imparted by the threaded bolt.

Document U.S. Pat. No. 2,147,496 describes a notched metal corner picket and a strengthening element comprising another notched picket and an articulated unit having at the extremities thereof metal triangles cooperating with the notches of the pickets.

These documents describe particularly well-known elements that are difficult to implement as they require complex tools.

A "high tensile" fence is a hard-steel wire- or mesh-based fence tensioned to at least 130 to 150 kg for wire most commonly having a diameter of 2.5 mm or less.

Unlike mild-steel mesh or wire fences, which cannot be highly tensioned without the wire quickly beginning to deform irreversibly, a high-tensile fence must be made of hard-steel wire or mesh having a high carbon content and/or a high elastic limit. Such wire is often sold under the trade name Hi-Tensile or High-Tensile. It is usually in the form of 25 kg/600-650 m coils to be placed by the installer on an uncoiler of the diameter of the coil. An example of this wire is Securgal 25 (registered trademark) promoted by Lacmé in its commercial documentation for many years.

High-tensile fences are described in the documents "High-tensile Wire Fencing" from the Northeast Regional Agricultural Engineering Service, 1987, and "How to Build Fences with USS Max-Ten 200 High-tensile Fence Wire" from United States Steel, 1980. These fences are based on line pickets and corner posts. If the line pickets are made of metal, the cross-section thereof is normally T or Y shaped (the latter also being referred to as "star shaped"). T-shaped pickets are for example described in patents U.S. Pat. Nos. 1,454,649 and 5,042,591. Y-shaped pickets are for example illustrated in the documentation "The Waratah Fencing Range October 2009" from One Steel Market Mills, 2009.

One of the main problems for users wishing to erect a high-tensile fence without using the services of a specialist is the installation of the "line start/end" and "corner" posts. Indeed, line start/end posts and corner posts need to be particularly robust such as to withstand, from the outset and over time, the high mechanical tension applied to this type of fence.

A known solution involves using large-diameter wooden stakes for the line start/end posts and the corner posts. One drawback of this solution is that wooden stakes are cumbersome and heavy. Furthermore, wooden stakes are liable to decay. Moreover, these stakes, on account of the round or semi-circular section thereof, become less well anchored in the ground over time compared to metal pickets having more complex cross sections. Finally, to implement this solution, users need to master the use of several wood tools including a chainsaw and a pneumatic, thermal or hydraulic post driver to fit the wooden stakes into one another and to anchor them in the ground.

Another known solution involves using metal pickets and strengthening elements for the line start/end posts and the corner posts. Metal pickets are easier to drive into the ground, for example using a cylindrical post driver. The strengthening element may be a metal mooring or strut.

In the case of a mooring, it must be placed outside the fenced area, which reduces the space usable by the landowner, and may also cause safety problems related to the possibility of passers-by tripping over the mooring. Furthermore, moorings cannot be used for the two line start/end posts of a gateway for animal herds, since such moorings would necessarily hinder the movement of the herd passing through the gateway.

The use of struts requires specific parts manufactured in small quantities that are little-known and costly, not obvious to use, and rarely available from retail outlets. These parts also have to be transported to and then onto the installation site. In certain circumstances, such as the installation of corner posts and line start/end posts in very steep or mountainous areas, this may be an insurmountable problem. Furthermore, to assemble the strut, it is often necessary to use tightening, adjustment and/or bolting tools, which generate additional constraints in terms of weight, encumbrance and cost. Furthermore, the complexity of the work is increased by having to plan the exact number of parts required to install the corner and/or line start/end posts. Finally, struts are horizontal elements formed by a rigid rod occupying a significant amount of space.

BRIEF SUMMARY OF THE INVENTION

This invention is intended to disclose a line start/end post or a corner post of a fence that avoids at least some of the drawbacks mentioned above, that is easy to assemble, and that uses conventional parts in such volumes when erecting fences that the exact number is not planned when preparing the works. These parts are consequently manufactured in large quantities and are cheap.

Accordingly, the invention relates to a line start/end post or corner post of a fence, comprising a first metal picket, designed to be driven into the ground in a substantially vertical position, and a strengthening element, said strengthening element having a second metal picket, designed to be arranged obliquely between said first picket and the ground, and a link element, designed to link a first extremity of said second picket, placed on the ground, to said first picket, characterized in that said second picket is a line picket of the fence, and said link element is made of fence wire. For example, the fence wire is able to withstand high traction greater than 200 kg.

Advantageously, said first picket has a U- or W-shaped section, and said second picket has a T- or Y-shaped section. Said second picket is conventionally otherwise used as a "line" picket of a high-tensile fence.

Preferably, said first extremity of said second picket, which would be beneath the surface of the ground if said picket were driven into the ground as a line picket, is pointed and has a "lower" hole intended to receive said link element.

According to one embodiment of the invention, said link element is formed by a complete loop of the fence wire.

Preferably, the loop of said link element is closed using a joiner.

Advantageously, said post has a strengthening element placed in the "lower" hole of said second picket, the wire forming said link element being threaded through said hole and bearing against said strengthening element.

According to another embodiment of the invention, said link element is provided by one or more individual branches of fence wire.

Advantageously, the or each wire branch is attached using locking devices.

Preferably, said post includes a metal non-sink part having a U- or W-shaped section, that is placed on the ground beneath said first extremity of said second picket, said non-sink part having a flat surface larger than the section of said first extremity of said second picket, said non-sink part comprising an end portion cut away from said first picket, said first picket including a pre-cut line enabling said non-sink part to be disconnected from said first picket.

According to one embodiment of the invention, said second picket has, around the second extremity thereof, facing said first extremity, a bevelled indentation.

Advantageously, said first picket has a notch designed to receive a portion of the second extremity of said second picket.

Advantageously, said first picket has a W-shaped section, the two legs of the W being sufficiently close to one another and sufficiently deep for said portion of said second extremity, inserted in said notch, to be arranged between the legs of the W. This prevents the possibility of accidents involving animals or children rubbing against the post at this point.

Advantageously, said post has a protective cap, that can be placed on an extremity of said first picket, said protective cap having quick-connection means and/or holes able to receive the elements required to assemble the post before said assembly (strengthening element, rod and bolt, etc.).

The invention also concerns an assembly method for a line start/end post or corner post of a fence, characterized in that it includes the following stages:

- Driving a first metal picket into the ground, in a substantially vertical position,
- Placing a second metal picket, generally otherwise used as a line picket of the fence, obliquely between said first picket and the ground,
- Placing a link element between a first extremity of said second picket, placed on the ground, and said first picket, said link element being made of fence wire,
- Bearing against a second extremity of the second picket, cooperating with said first picket, until a predetermined position is reached, and
- Locking said second extremity in position in relation to said first picket.

Preferably, the stage of locking said second extremity in position in relation to said first picket is effected by inserting said portion of the second extremity of said second picket into a notch of said first picket.

Alternatively, the stage of locking said second extremity in position in relation to said first picket is effected, firstly, by the friction between said second extremity and said first picket, and, secondly, by inserting a rod and a bolt into two through holes of said first picket.

The invention is further explained, along with additional objectives, details, characteristics and advantages thereof, in the detailed description below of an embodiment of the invention given as a purely illustrative and non-limiting example, with reference to the schematic drawings attached.

DETAILED DESCRIPTION OF THE PREFERRED EMBODIMENTS

Figure 1:
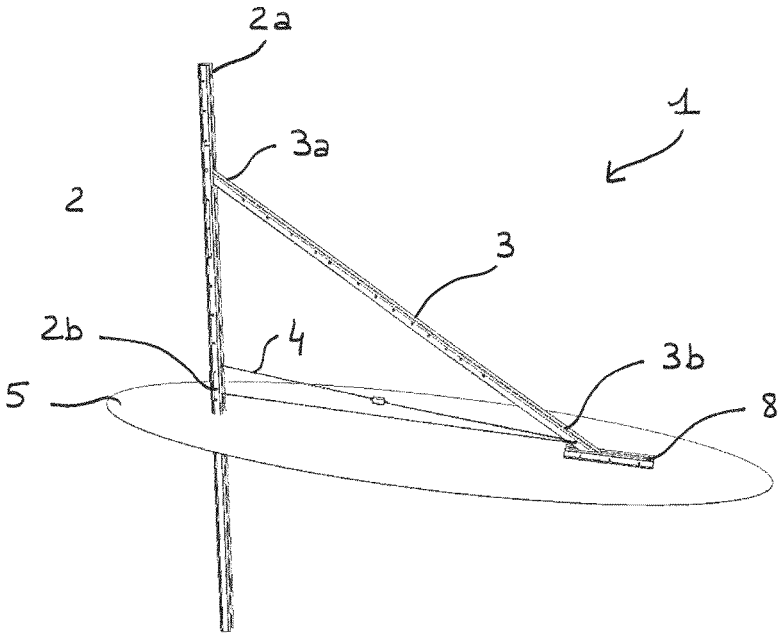
FIG. 1 is a simplified schematic perspective view of a line start/end post or a corner post of a fence, according to one embodiment of the invention.

FIG. 1 shows a line start/end post or a corner post 1, which is designed to be used to form a high-tensile fence of steel wire or mesh. The fence may be an electric fence or a purely mechanical fence.

The post 1 has a first metal picket 2 and a strengthening element. The strengthening element has a second metal picket 3 and a link element 4.

The first picket 2 is intended to be driven into the ground 5 in a substantially vertical position. The first picket 2 has a U-shaped section. Alternatively, the first picket 2 may have a V- or W-shaped section.

Figure 2:
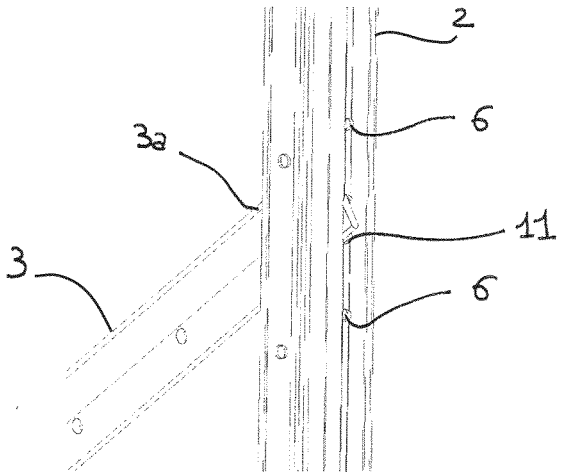
FIG. 2 is a perspective view showing the engagement of one extremity of a second picket of the post in FIG. 1 in a first picket of said post with locking in a notch.
Figure 19:
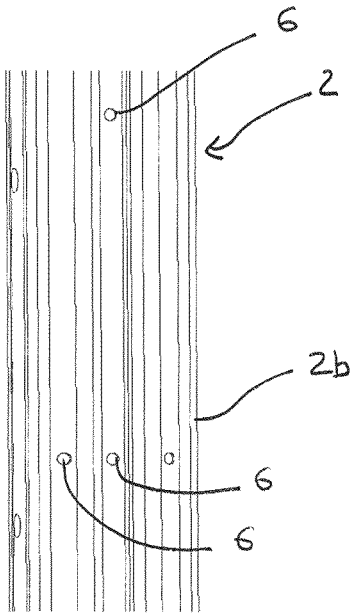
FIG. 19 is a perspective view showing an alternative embodiment of the first picket.

With reference to FIG. 2, the first picket 2 has, at the bottom of the U, a set of small holes 6 each enabling the passage of one or two fence wires (not shown), for example high-tensile wires. These holes 6, typically spaced 10 cm apart, are aligned vertically along a longitudinal axis of the first picket 2. In a variant shown in FIG. 19, the hole 6 intended to be located at ground level is replaced or augmented by a pair of additional holes.

The first picket 2 also has, at the bottom of the U, substantially halfway up, a guide slot (not shown in the figures) able to guide an extremity 3*a* of the second picket 3 in a substantially vertical direction, as described in detail below.

With reference to FIGS. 1 and 2, the second picket 3 is designed to be arranged obliquely between the first picket 2 and the ground 5. The second picket 3 has a Y-shaped section. Alternatively, the second picket 3 may have a T-shaped section. Such pickets are preferably those commonly used as "line" posts of a high-tensile electric fence. The second picket 3 forms a strut.

Figure 4:
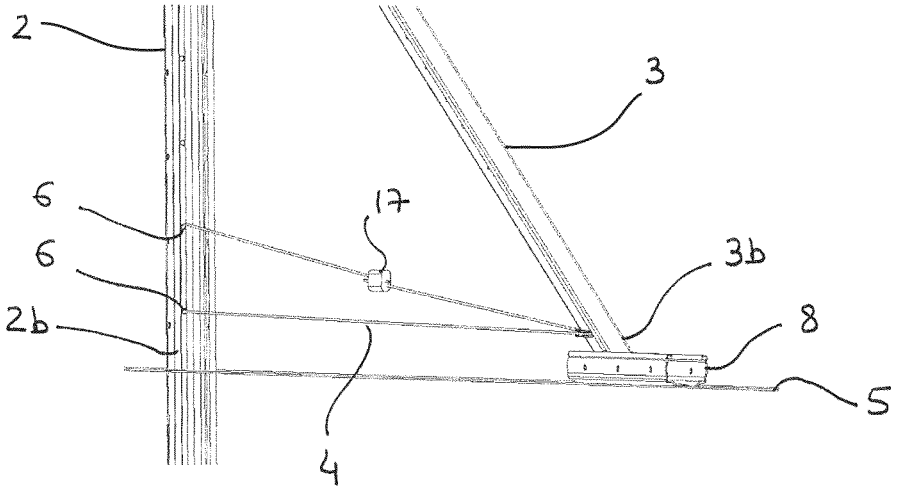
FIG. 4 is a perspective view showing a link element of the post in FIG. 1, the link element linking the first picket and the second picket.
Figure 6:
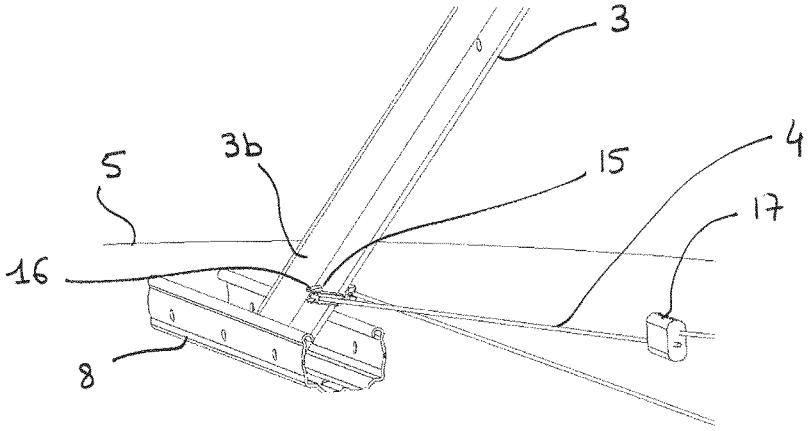
FIG. 6 is a perspective view from another angle showing a link element of the post in FIG. 1.

With reference to FIGS. 1, 4 and 6, the link element 4 is designed to link the extremity 3*b* of the second picket 3, which is placed on the ground 5, with the base 2*b* of the first picket 2. The base 2*b* of the first picket 2 is the zone of the first picket 2 that is just above the ground when the first picket 2 has been installed by driving it into the ground 5. The link element 4 is therefore arranged in a substantially horizontal plane.

The link element 4 must be able to withstand significant mechanical traction stresses. Indeed, the link element 4 is the element of the picket 1 that bears the greatest traction force, for example around 400 to 500 kg. It shall be noted that the force exerted on the link element depends on the number of wires in the fence. The link element 4 must be arranged substantially horizontally to fulfil the function of closing the force system and opposing the lifting of the first picket 2. The wire link element 4 is for example made using fence wire able to withstand traction greater than 200 kg, for example high-tensile wire. Preferably, the wire used to form the link element 4 is exactly the same wire as used in the remainder of the fence.

Consequently, the number of components used to make the post 1 is firstly reduced and secondly limited to the components also used in the straight-line part of the electric fence. This has the advantage of reducing the price, facilitating the purchase of these components, and simplifying organisation of logistics and planning of the work.

Assembly of the post 1 is described below.

To do so, the first picket 2 is driven into the ground 5, for example using a post driver (not shown). In a known manner, the size of the post driver may be adapted to the size of the first picket 2, such that the picket is driven to the correct depth (in relation to the different holes provided in the first picket 2) when the bottom of the post driver touches the ground 5.

When the first picket 2 has been driven into the ground 5, the second picket 3 is installed such that the upper extremity 3*a* thereof is inserted into the U of the first picket 2 above a predetermined marker, and such that the lower extremity 3*b* thereof (if it had been used as a "line" picket) rests on the ground 5, at an implicitly predetermined distance (since the heights of the Y-shaped "line" pickets are more or less constant from one supplier to another) from the base 2*b* of the first picket 2.

Figure 5:
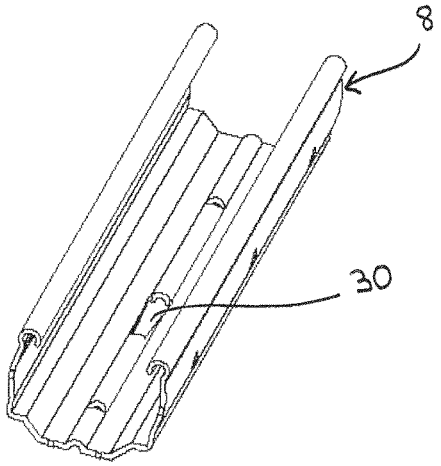
FIG. 5 is a perspective view showing a non-sink part of the post.
Figure 7:
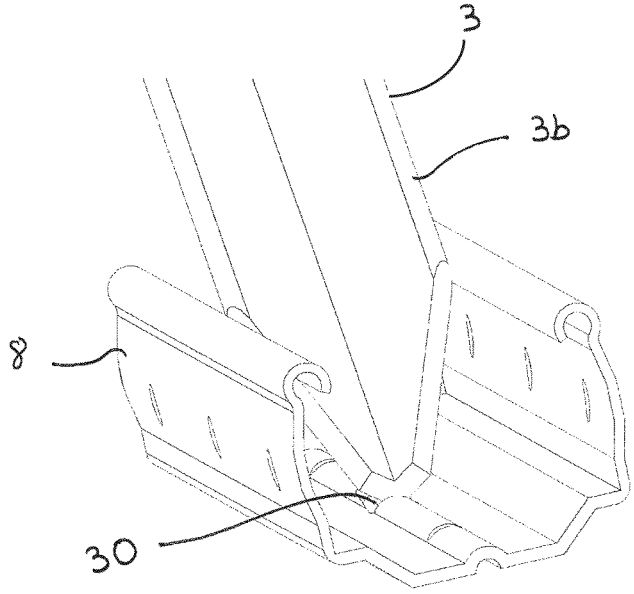
FIG. 7 is a perspective view showing the engagement of the first picket in the non-sink part.

The second picket 3 may bear against a non-sink part 8, which is placed on the ground 5 beneath the extremity 3*b*. The anti-sink part 8 has a flat surface larger than the section of the extremity 3*b*. The anti-sink part 8 may advantageously be formed by several centimetres cut away from an extremity of the first picket 2. The anti-sink part 8 is in this case a metal rail having a U- or W-shaped section identical to the section of the picket 2. The rail can then guide the extremity 3*b* of the picket 3 during assembly. The rail may include a slot (FIGS. 5 and 7) or a hole enabling the extremity 3*b* of the second picket 3 to be positioned and then locked in longitudinal translational movement during assembly of the corner or line start/end post.

Figure 8:
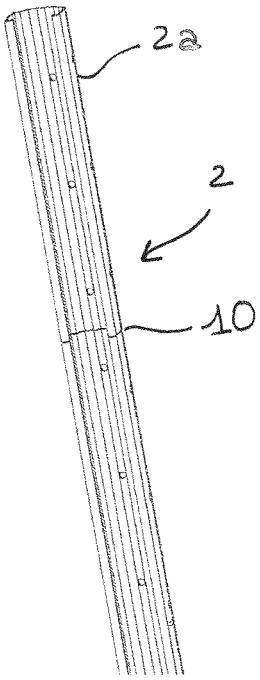
FIG. 8 is a perspective view showing a portion of the first picket according to an alternative embodiment of the invention.

The first picket may advantageously include a pre-cut line 10 (FIG. 8). Accordingly, the corresponding extremity of the first picket 2 need merely be knocked against a stone or using a tool to separate the anti-sink part 8 from the first picket 2. This enables retailers to offer a single but complete picket 2 that is ready for use for making a line start/end post or a corner post 1. This also prevents the user from losing the anti-sink part 8 between purchase and assembly of the post 1.

For assembly, the extremity 3*a* of the second picket 3 is firstly placed level with a predetermined upper threshold of the first picket 2. The upper threshold is for example one of the holes 6. Alternatively, the upper threshold may be a mark engraved or inscribed on the first picket 2.

The link element 4 is then installed. The link element is for example formed by a complete loop of fence wire.

Figure 16:
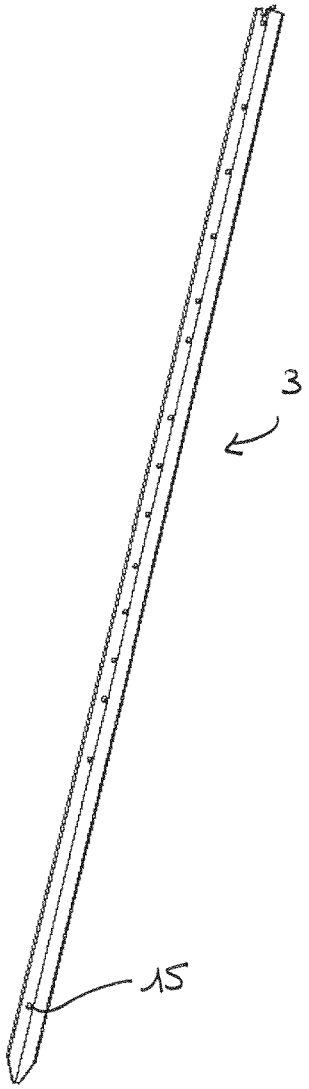
FIG. 16 is a perspective view of the second picket showing a "lower" hole through which the link element passes.

Preferably, to enable the passage of the wire forming the link element 4, the second picket 3 has a "lower" hole 15 (FIGS. 6 and 16) close to the lower extremity 3*b* thereof. This hole is original because it would be beneath ground level if said picket were otherwise conventionally driven into the ground as a line picket.

Figure 17:
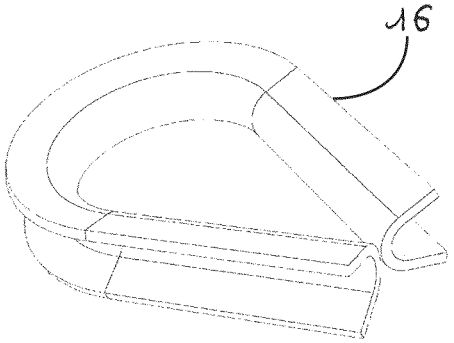
FIG. 17 is a perspective view of a strengthening element of the post.

The post 1 may include a cable-thimble strengthening element 16, clearly shown in FIG. 17. In this case, the strengthening element 16 is inserted in the "lower" hole 15, then the wire forming the link element 4 is threaded through the "lower" hole 15 bearing against the strengthening element 16, as shown in FIG. 4. The strengthening element 16 makes it possible to increase the curvature radius of the loop of the link element 4, and therefore to limit shearing.

Figure 18:
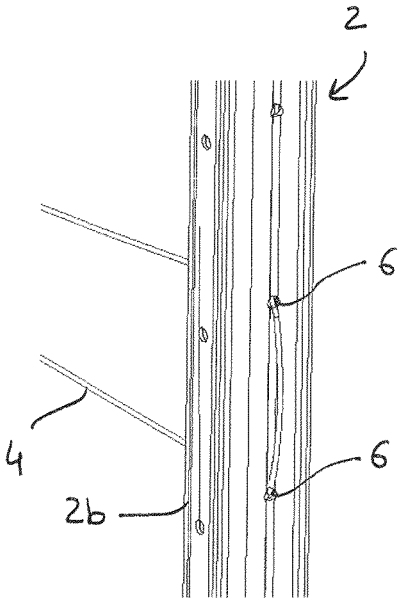
FIG. 18 is a perspective view showing an example passage of the link element in the first picket.

In the first picket 2, the loop of the link element 4 is formed by threading the wire into a first hole 6 of the set of holes 6, and bringing it out through a second hole 6 of the set of holes 6 arranged just above or just below the first hole 6 (FIGS. 4 and 18). In the variant shown in FIG. 19, the wire enters through a hole 6 of the pair of holes, and comes out through the second hole 6 of the pair of holes. This makes it possible to obtain a link element 4 arranged in a more horizontal plane.

The loop of the link element 4 may be closed using a conventional joiner 17 (FIG. 4). Alternatively, the loop may be closed using a simple knot.

According to a variant not shown, the link element 4 may be formed by one or more individual branches of fence wire, for example high-tensile wire. The individual branch or branches are attached firstly to the extremity 3*b* of the second picket 3 and secondly to the base 2*b* of the first picket 2. The or each wire branch may be attached using conventional locking devices placed behind the corresponding holes. Well-known to the person skilled in the art, a locking device is a mechanism similar to a joiner, but cheaper as it only has one wire channel. If the user does not have a locking device, he may use a joiner, of which he will only use one of the two channels, thereby turning it into a simple locking device. The rupture points of the locking devices/joiners may be selected so that they operate like fuses, i.e. if the mechanical tension is too great in the fence wires, the post 1 breaks at the level thereof before any excessive irreversible mechanical deformations are caused in the pickets 2, 3.

The user then presses against the extremity 3*a* of the second picket 3, which causes the extremity 3*a* to slide along the guide slot of the first picket 2, between the upper threshold and a predetermined lower threshold. It will be noted that this operation is performed without the extremity 3*b* of the second picket 3 moving considerably. When the extremity 3*a* reaches the lower threshold, the extremity 3*a* is locked in position.

The second picket 3 forming the strut may then be installed without using tools. Preferably, the distance between the respective edges of the two arms of the Y of the second picket 3 is very slightly less than the distance between the two branches of the U of the first picket 2, to facilitate sliding and guiding.

Figure 9:
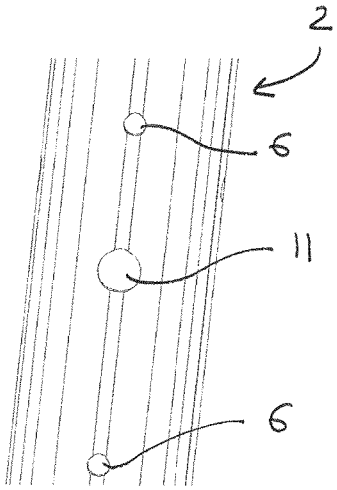
FIGS. 9 to 11 are perspective views showing three alternative embodiments of a notch of the first picket intended to receive an extremity of the second picket.
Figure 10:
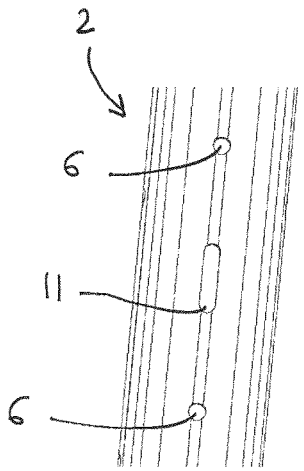
Figure 11:
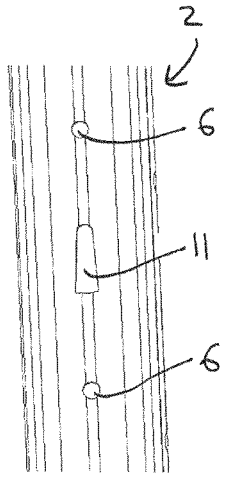

With reference to FIGS. 9 to 11, the lower threshold is formed by a notch, which may be blind or otherwise, for example a cut-out section 11, in the base of the U of the first picket 2, in which the extremity 3*a* of the second picket 3 is engaged at the end of the sliding movement.

The cut-out section 11 may be round and of greater diameter than the holes 6 (FIG. 9). Alternatively, the cut-out section 11 may be oblong (FIG. 10) or trapezoidal with the small horizontal side of the trapezium on top (FIG. 11).

Figure 22:
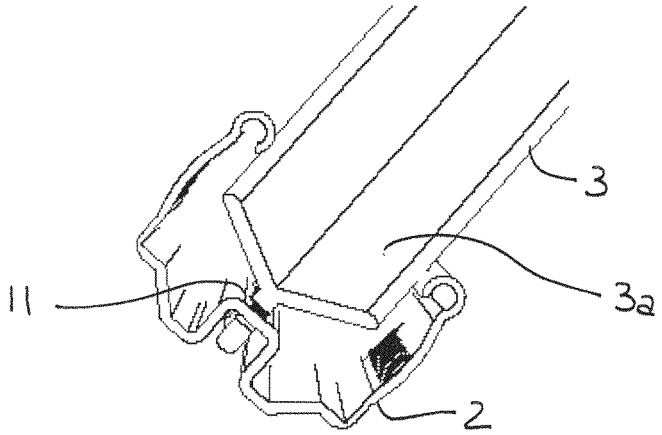
FIG. 22 is a perspective top view showing the engagement of the second picket in the first picket when the first picket has a W-shaped section.

In the example shown in FIG. 22, the first picket 2 has a W-shaped section, the two legs of the W being sufficiently close to one another and sufficiently deep for the portion of the second extremity 3*a*, inserted in the notch, to be arranged between the legs of the W.

Figure 12:
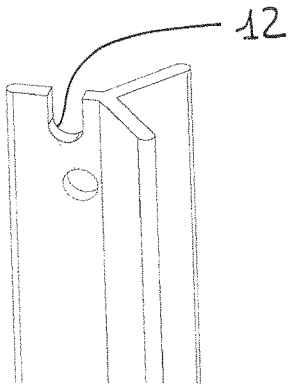
FIG. 12 is a partial perspective view showing an extremity of a conventional Y-shaped line picket of a fence.
Figure 13:
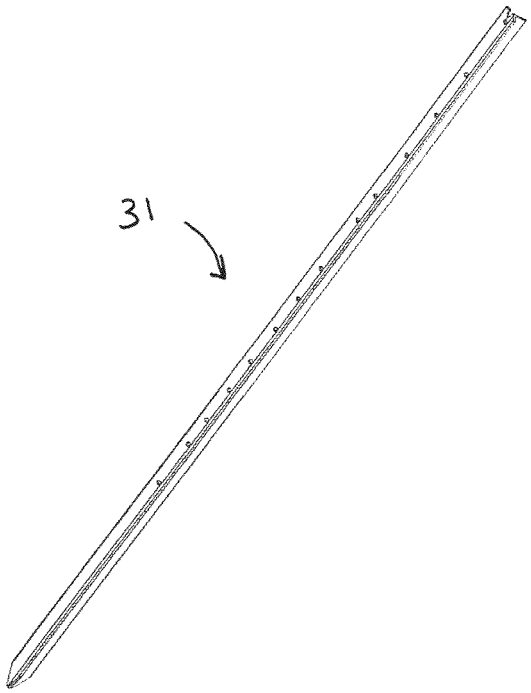
FIG. 13 is a perspective view showing a conventional Y-shaped line picket of a fence.
Figure 14:
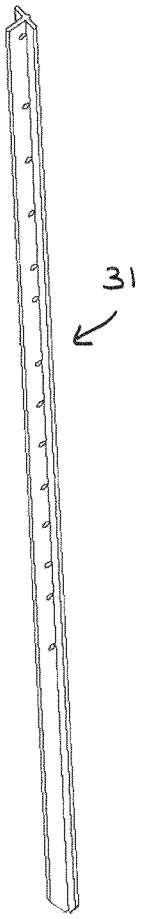
FIG. 14 is a perspective view showing a conventional T-shaped line post of a fence.
Figure 15:
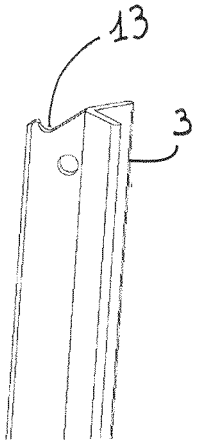
FIG. 15 is a view similar to FIG. 12 showing an extremity of the second picket according to an alternative embodiment of the invention.

In general, the pickets 3 used for "line" posts have, at the upper extremity thereof, a notch 12 that is always rectangular, as shown in FIG. 12. In the second picket 3, this rectangular notch may be replaced by a bevelled indentation 13, as shown in FIG. 15. The bevelled indentation 13 makes it possible to increase the contact surface between the second picket 3 and the contour of the cut-out section 11. The bevelled indentation 13 also makes it possible to limit the part of the second picket 3 passing the bottom of the U through the cut-out section 11, which limits the risk of personal injury. It will be noted that this indentation 13 does not prevent the second picket 3 from being used as a line picket.

Figure 3:
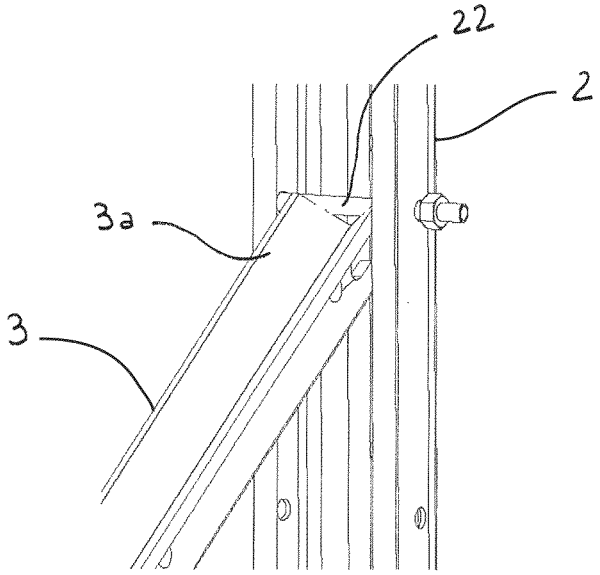
FIG. 3 is a perspective view showing the engagement of one extremity of a second picket of the post in FIG. 1 in a first picket of said post with securing by rod and bolt.

According to a variant shown in FIG. 3, the lower threshold may be formed by a transversal rod 22 placed between the branches of the U of the first picket 2, once the extremity 3*a* has been lowered to the lower threshold. In this variant, once it has been moved to the lower threshold, the extremity 3*a* is wedged by friction in the first picket 2, and the rod 22 prevents the extremity 3*a* from lifting, in the event of impact or wear.

Figure 20:
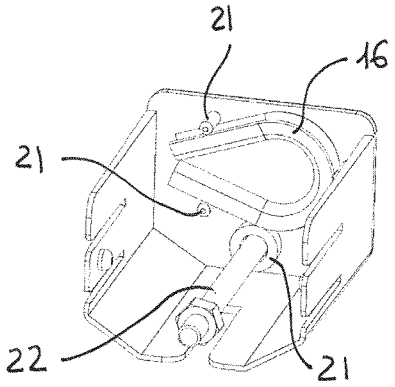
FIG. 20 is a perspective view showing a protective cap of the post.
Figure 21:
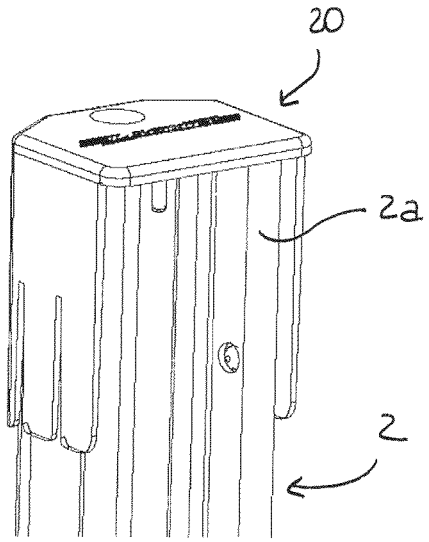
FIG. 21 is a perspective view showing the protective cap in FIG. 20 placed on the first picket.

With reference to FIGS. 20 and 21, the post 1 includes a protective cap 20 placed on the top 2*a* of the first picket 2. The protective cap 20 is made of moulded plastic and includes quick-attachment means 21 and/or holes to receive the strengthening elements 16 and/or any nuts and bolts 22 required to assemble the post 1.

Although the invention has been described in relation to a specific embodiment, it is evidently in no way limited thereto and it includes all of the technical equivalents of the means described and the combinations thereof where these fall within the scope of the invention.

The invention claimed is:

1. A line start/end post or corner post (1) assembly for a fence made of line pickets and fence wire, comprising:

a first metal picket (2), designed to be driven into the ground (5) in a substantially vertical position, said first picket including an end portion extending from a pre-cut line (10), the pre-cut line (10) enabling, by knocking against a stone, the end portion to be disconnected from the first picket (2), wherein when disconnected from the first picket, the end portion defines a non-sink part (8); and a strengthening element, said strengthening element comprised of i) a second metal picket (3), designed to be arranged obliquely between said first picket (2) and the ground (5), ii) a link element (4) made of fence wire, designed to link a first extremity (3*b*) of said second picket (3), placed on the ground (5), to said first picket (2), and iii) the non-sink part (8), wherein said first picket (2), including the end portion, has a U- or W-shaped section with a flat surface larger than a section of said first extremity (3*b*) of said second picket (3) such that said non-sink part can be placed on the ground (5) beneath said first extremity (3*b*) of said second picket (3), wherein said second picket (3) can be used as a line picket of the fence and has a T- or Y-shaped section, and wherein said link element (4) is arranged in a substantially horizontal plane, and wherein said line start/end post or corner post (1) includes only, and no more than, two pickets, namely the first and second pickets.

2. The post assembly according to claim 1, wherein said first extremity (3*b*) of said second picket (3), which would be beneath the surface of the ground if said picket were driven into the ground as a line picket, is pointed and has a lower hole (15) intended to receive said link element (4).

3. The post assembly according to claim 2, wherein said strengthening element includes a cable-thimble strengthening element (16) and the wire forming said link element (4) is threaded into said lower hole (15) and bears against said cable-thimble strengthening element (16).

4. The post assembly according to claim 1, wherein said link element (4) is only formed by a full loop of fence wire.

5. The post assembly according to claim 4, wherein a knot or a two-wire joiner (17) closes the loop of said link element (4).

6. The post assembly according to claim 1, wherein said link element (4) is only formed by one or more individual branches of fence wire.

7. The post assembly according to claim 6, wherein each branch of said link element is fixed firstly to the second metal picket (3) and secondly to a base (2*b*) of the first metal picket (2) using locking devices.

8. The post assembly according to claim 1, wherein said second picket (3) has, around a second extremity thereof, facing said first extremity, a beveled indentation (13).

9. The post assembly according to claim 1, wherein said first picket (2) has a notch (11) designed to receive a portion of the second extremity (3*a*) of said second picket (3).

10. The post assembly according to claim 9, wherein said first picket (2) has the W-shaped section, the two legs of the W being sufficiently close to one another and sufficiently deep for said portion of said second extremity (3*a*), inserted in said notch (11), to be arranged between the legs of the W.

11. The post assembly according to claim 1, wherein said strengthening element includes a cable-thimble strengthening element (16), wherein the second metal picket (3) is connected, via a connecting element (22), obliquely between said first picket (2) and the ground (5), and said first metal picket (2) further includes a protective cap (20), that can be placed on an extremity (2*a*) of said first picket (2), said protective cap (20) having at least one of the group consisting of quick-connection means (21) and holes holding said cable-thimble strengthening element (16) and said connecting element (22), required to assemble the post (1), before said assembly.

12. The post assembly according to claim 1, wherein, the fence wire of said link element (4) bears a traction force in a range of 400 to 500 kg.

13. A line start/end post or corner post (1) assembly for a fence made of line pickets and fence wire, comprising:

a first metal picket (2) to be driven into the ground (5) in a substantially vertical position, said first picket (2) having an end portion extending from a pre-cut line (10), the pre-cut line (10) enabling, by knocking against a stone, the end portion to be disconnected from the first picket (2), wherein, when disconnected from the first picket, the end portion defines a non-sink part (8); and a strengthening element comprised of i) a second metal picket (3) with a T- or Y-shaped section, the second picket having a first extremity (3*b*), a second extremity (3*a*), and a lower hole (15) at the first extremity (3*b*), ii) a connecting element (22), iii) a fence wire link element (4), and iv) the non-sink part (8), wherein said first picket (2), including the end portion, has a U- or W-shaped section with a flat surface larger than a section of said first extremity (3*b*) of said second picket (3) such that said non-sink part can be placed on the ground (5) beneath said first extremity (3*b*) of said second picket (3), and wherein, in an assembled state as a line start/end post or corner post (1), with the first picket driven into the ground (5) in a substantially vertical position, the non-sink part placed on the ground (5) beneath said first extremity (3*b*) of said second picket (3), and the second extremity (3*a*) of the second metal picket (3) connected, via said connecting element (22), to said first metal picket (2), as a strut running obliquely between said first picket (2) and the ground (5), the fence wire link element (4) is thread through the lower hole (15) adjacent the ground (5) and to a base of said first picket (2) thereby linking a first extremity (3*b*) of the second picket (3) adjacent the ground 5, with the base (2*b*) of the first picket (2), the fence wire link element (4) being arranged in a substantially horizontal plane and bearing a traction force greater than 200 kg, said line start/end post or corner post (1) includes only, and no more than, two pickets, namely the first and second pickets.

14. The post assembly according to claim 13, wherein, the fence wire link element (4) bears the traction force in a range of 400 to 500 kg.

15. A line start/end post or corner post (1) assembly for a fence made of line pickets and fence wire, comprising:

a first metal picket (2) to be driven into the ground (5) in a substantially vertical position, said first picket (2) having an end portion extending from a pre-cut line (10), the pre-cut line (10) enabling, by knocking against a stone, the end portion to be disconnected from the first picket (2), wherein, when disconnected from the first picket, the end portion defines a non-sink part (8); and a strengthening element comprised of i) a second metal picket (3) with a T- or Y-shaped section, the second picket having a first extremity (3*b*), a second extremity (3*a*), and a lower hole (15) at the first extremity (3*b*), ii) a connecting element (22), iii) a cable-thimble strengthening element (16), iv) a fence wire link element (4), and iv) the non-sink part (8), wherein said first picket (2), including the end portion, has a U- or W-shaped section with a flat surface larger than a section of said first extremity (3*b*) of said second picket (3) such that said non-sink part (8) can be placed on the ground (5) beneath said first extremity (3*b*) of said second picket (3), and wherein, in an assembled state as a line start/end post or corner post (1), with the first picket driven into the ground (5) in a substantially vertical position, the non-sink part placed on the ground (5) beneath said first extremity (3*b*) of said second picket (3), and the second extremity (3*a*) of the second metal picket (3) connected, via said connecting element (22), to said first metal picket (2), as a strut running obliquely between said first picket (2) and the ground (5), said cable-thimble strengthening element (16) is threaded into said lower hole (15), and said fence wire link element (4) is threaded through said lower hole (15) bearing against said cable-thimble strengthening element (16) and to a base of said first picket (2) thereby linking a first extremity (3*b*) of the second picket (3) adjacent the ground 5, with the base (2*b*) of the first picket (2), the fence wire link element (4) being arranged in a substantially horizontal plane and bearing a traction force greater than 200 kg, said line start/end post or corner post (1) includes only, and no more than, two pickets, namely the first and second pickets.

16. The post assembly according to claim 15, wherein, said first metal picket (2) further includes a protective cap (20), placed on an upper extremity (2*a*) of said first metal picket (2), said protective cap (20) having at least one of the group consisting of holes and quick-connection means (21) that hold said cable-thimble strengthening element (16) and said connecting element (22) prior to assembly of the protective cap on the upper extremity of said first metal picket (2).

17. The post assembly according to claim 15, wherein, the fence wire link element (4) bears the traction force in a range of 400 to 500 kg.

* * * * *